US008110134B2

(12) United States Patent
Scott et al.

(10) Patent No.: US 8,110,134 B2
(45) Date of Patent: Feb. 7, 2012

(54) MANUFACTURING CEMENTITIOUS REINFORCING SUPPORT DEVICES

(76) Inventors: Mark Allison Scott, Superior, CO (US); Douglas W. Myers, Highlands Ranch, CO (US)

( * ) Notice: Subject to any disclaimer, the term of this patent is extended or adjusted under 35 U.S.C. 154(b) by 1008 days.

(21) Appl. No.: 12/043,113

(22) Filed: Mar. 5, 2008

(65) Prior Publication Data

US 2008/0220268 A1 Sep. 11, 2008

Related U.S. Application Data

(60) Provisional application No. 60/893,037, filed on Mar. 5, 2007.

(51) Int. Cl.
*E04C 5/16* (2006.01)

(52) U.S. Cl. ..... 264/297.9; 264/297.4; 52/677; 249/126

(58) Field of Classification Search ..... 264/297.4, 264/297.9; 52/677; 249/126
See application file for complete search history.

(56) References Cited

U.S. PATENT DOCUMENTS

| | | | | |
|---|---|---|---|---|
| 1,788,180 | A * | 1/1931 | White | 52/677 |
| 2,725,611 | A * | 12/1955 | Wissinger | 249/126 |
| 3,191,796 | A * | 6/1965 | Schwartz et al. | 220/23.6 |
| 3,352,528 | A * | 11/1967 | Bernstrom et al. | 249/126 |
| 4,534,924 | A * | 8/1985 | Kariakin | 264/259 |
| 2006/0249981 | A1 * | 11/2006 | Heuel et al. | 296/146.8 |

* cited by examiner

*Primary Examiner* — Christina Johnson
*Assistant Examiner* — Galen Hauth
(74) *Attorney, Agent, or Firm* — Merchant & Gould

(57) ABSTRACT

Lightweight trays are fabricated containing a multitude of cavities in shapes for molding dobies for supporting concrete reinforcing, such as rebar. The trays are sized to fit boxes of a convenient size and weight. The trays are also designed in a way that when placed into the box they make a seal between the tray edges and the inside wall of the box. This seal allows the cavities in the tray to be filled with grout without spilling into a lower tray. The trays are also designed so that when placed into the box and turned, alternating 180° to each other, the lower tray provides support to the upper tray. The boxes are sealed and the dobies are allowed to cure inside the box. The size and arrangement of trays and boxes is designed to fit uniformly on a standard pallet for convenient handling, storage, and shipping.

9 Claims, 11 Drawing Sheets

MANUFACTURING CEMENTITIOUS REINFORCING SUPPORT DEVICES

CROSS-REFERENCES TO RELATED APPLICATIONS

This application claims the benefit of U.S. Provisional Application Ser. No. 60/893,037 filed on Mar. 5, 2007 titled "METHOD AND MATERIALS FOR THE MANUFACTURE OF CEMENTITIOUS REINFORCING SUPPORT DEVICES" which is incorporated herein by reference in its entirety for all that is taught and disclosed therein.

BACKGROUND

The present invention relates generally to production equipment and a process to manufacture cementitious reinforcing support devices, called dobies, that are used to control the placement, spacing, and location of concrete reinforcing materials utilized in concrete construction. In particular, the present invention utilizes preformed, lightweight trays that may be shipped to the point of sale, and filled on location at the point of sale to produce the reinforcing support devices needed for the construction project.

SUMMARY

This Summary is provided to introduce in a simplified form a selection of concepts that are further described below in the Detailed Description. This Summary is not intended to identify key features or essential features of the claimed subject matter, nor is it intended to be used to limit the scope of the claimed subject matter.

Plastic, styrene, fiberglass, or other moldable or formable lightweight material is fabricated into trays containing a multitude of cavities in shapes for molding dobies for supporting concrete reinforcing members, such as concrete reinforcing steel bars (commonly known as "rebar"), PC Strand, which is high tensile stranded wire, wire mesh, tubing, structural steel, and the like. The cementitious material is typically a grout composed of a mixture of water, cement, and sand, or sometimes fine gravel. The term "grout" as used in this disclosure is intended to include any suitable cementitious material.

The fabricated trays are stackable and preferably nest together so that many trays may be shipped together in a small package or container. The trays are sized to fit boxes of a convenient size and weight for lifting and moving by hand. The trays are also designed in a way that when placed into the box they make a seal between the tray edges and the inside wall of the box. This seal allows a tray to be filled with grout, in the box, without spilling into a lower tray. This significantly reduces the manufacturing labor required in comparison to current manufacturing practices. In one embodiment, the trays are also designed so that when placed into the box and turned, alternating 180° to each other, the lower tray provides support to the upper tray in a way that substantially prevents damage to the contents of the lower tray.

The inside surfaces of the boxes are moisture proof. This allows for curing of the dobies within the box in a moist environment. This provides an optimum curing condition for the dobies. The size and arrangement of trays and boxes are also preferably designed to fit uniformly on a standard four-foot-by-four-foot pallet for convenient handling, storage, and shipping of the finished product. The entire manufacturing process takes place in the boxes and on the pallet upon which the final product is stored and transported. This eliminates significant handling and packaging labor inherent in current manufacturing practices.

Using this manufacturing method a wide range of device shapes can be achieved in addition to the typical cube-shaped blocks. Many custom or special shapes including round, oval, truncated cone, truncated pyramid, or multi legged supports can be produced. The dobies may also include steel tie wire or metal or plastic clips that can be embedded into the devices for securing the devices to the reinforcing material. Devices may also have tapered holes formed through them, or other recesses, to allow other securing methods, or the insertion of auxiliary support or positioning appliances.

In one embodiment, the trays are filled using programmable grout mixing and pumping machines that are known in the art. The grout mixing and pumping machine produces a time programmable stream of grout. Individual time/duration cycles are programmed to match the exact volume of grout required for each tray. A cycle to fill a tray is initiated using a trigger located at the discharge nozzle by the machine operator. The operator triggers the cycle, grout is produced at the machine and pumped to the nozzle and into the tray, which has been placed inside a box. The operator uses a straightedge or squeegee device to insure the grout is uniformly distributed into the cavities in the tray. The operator moves to the next box containing an empty tray, triggers the cycle, and the process is repeated. Empty trays are placed into the boxes on top of the just filled trays, and these trays are then filled with grout. This layering process is repeated until the boxes are full. The lids of the boxes are then closed and sealed, trapping and retaining moisture within the boxes. This creates an optimum curing condition. Another layer of boxes may be placed on top of the filled and sealed boxes and tray filling recommences. This process continues until the specified number of boxes for a pallet have been filled and sealed.

The manufacturing equipment may also include a low-rise, easy to transport silo that is positioned to discharge into the grout mixing and pumping machine's feed hopper. High quality premixed dry grout materials are readily available nation wide. Premixed dry grout, of a specified mix design, is delivered to the manufacturing site in bulk bags by a grout material supplier. The bags are hoisted and emptied into the silo. The grout mixing and pumping machine is positioned directly below the silo with the silo discharge aligned with the feed hopper. The nozzle operator has only to pull a lever for several seconds to refill the feed hopper on the grout mixing and pumping machine. The operation of filling the trays is nearly continuous and extremely efficient.

DETAILED DESCRIPTION

Figure 1:
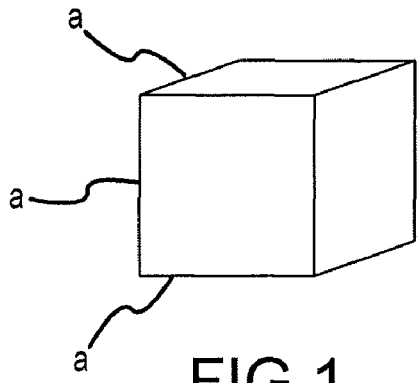
FIG. 1 shows an isometric view of a cube-shaped dobie.

Referring now to the Figures, in which like reference numerals and names refer to structurally and/or functionally similar elements thereof, FIG. 1 shows an isometric view of a cube-shaped dobie. Referring now to FIG. 1, Cube-Shaped Dobie 100 has a dimension a on all three sides that are essentially equal. The trays that have the cavities that produce Cube-Shaped Dobies 100 are made with a slight draft (slope) from top to bottom (larger at the top of the tray, and narrower at the bottom of the tray) so that the trays will nest and stack for shipping and so that the Cube-Shaped Dobies 100 will easily release from the tray once cured. The draft of the cavities is typical to all dobie types manufactured with this present approach.

Figure 2:
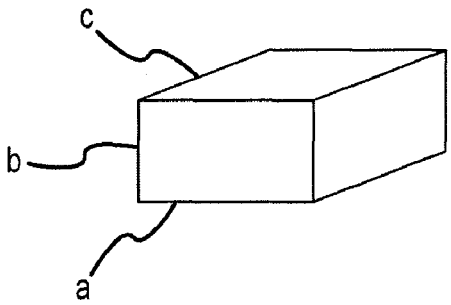
FIG. 2 shows an isometric view of a pan or multi-use dobie.

FIG. 2 shows an isometric view of a pan or multi-use dobie. Referring now to FIG. 2, the dimensions a, b, and c of Pan or Multi-Use Dobie 200 may all be different.

Figure 3A:
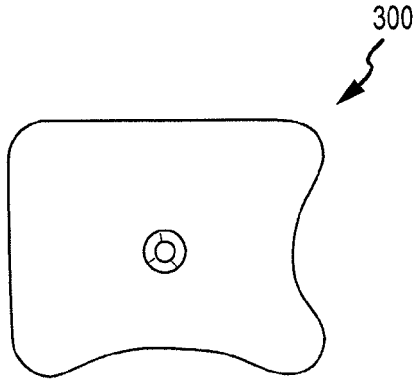
FIGS. 3A and 3B show a top and front view of a Pool/Euro dobie.
Figure 3B:
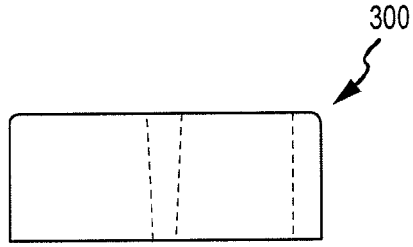

FIGS. 3A and 3B show a top and front view of a Pool/Euro dobie. Referring now to FIGS. 3A and 3B, Pool/Euro Dobie 300 is similar to Pan or Multi-Use Dobie 200 (FIG. 2) in that it has three different side dimensions. It has concave sides on two sides and a central tapered hole for tie wire insertion. The central hole allows for Pool/Euro Dobie 300 to be tie wired to the reinforcement that it is supporting while the concave sides help to insure that, once tied, Pool/Euro Dobie 300 will not rotate about the tapered hole and allow the support dimension to change. The tapered tie wire hole may be utilized with any of the dobie types described herein. Other types of securing appliances besides tie wire, such as metal or plastic clips, or springs, may be compatible with the central holes.

In another embodiment, securing appliances such as steel tie wire, metal or plastic clips, or springs for securing the reinforcement to the dobie can be embedded into the devices by affixing the securing appliances to the tray cavities prior to filing the tray cavities with grout, with the top portion of the securing appliances extending above the top surface of the tray. Thus, once cured, the securing appliances are securely embedded in each dobie, eliminating the step of securing the securing appliances to the dobies after they have cured. This approach may be utilized with any of the dobie styles described herein. A recess may be formed in the bottom of each cavity which supports the securing appliances in a vertical position while the grout is poured into the cavities. The securing appliances in one embodiment may be inserted from the bottom of the tray and then positioned to extend above the top surface of the tray.

Figure 4A:
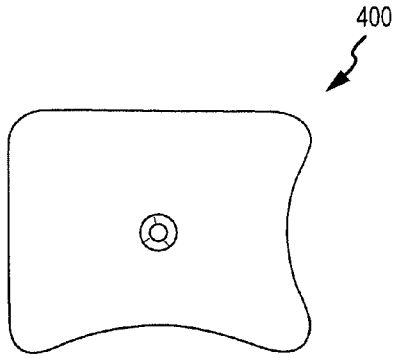
FIGS. 4A, 4B, and 4C show a top, front, and right side view of a legged Pool/Euro dobie.
Figure 4B:
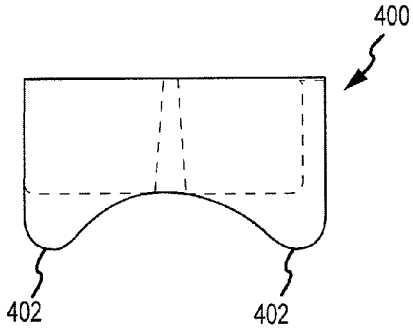
Figure 4C:
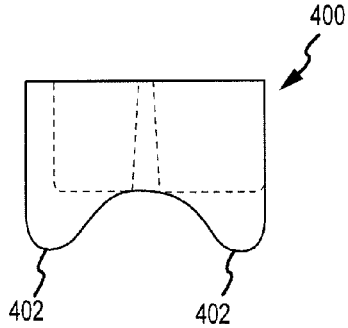

FIGS. 4A, 4B, and 4C show a top, front, and right side view of a legged Pool/Euro dobie. Referring now to FIGS. 4A, 4B, and 4C, Legged Pool/Euro Dobie 400 is similar to Pool/Euro Dobie 300 (See FIGS. 3A and 3B) with the addition of four Legs 402 on the bottom face. Legs 402 allow Legged Pool/Euro Dobie 400 to be used on a surface that will be exposed to view after removal of the forms. Legs 402 allow concrete, when it is being poured, to fill in under Legged Pool/Euro Dobie 400 and conceal it from view. Only the contact points of Legs 402 on the casting face are visible. If Legged Pool/Euro Dobie 400 is made out of grout similar in color and texture to the concrete; the contact points of Legs 402 would be nearly indistinguishable from the poured concrete.

Figure 5A:
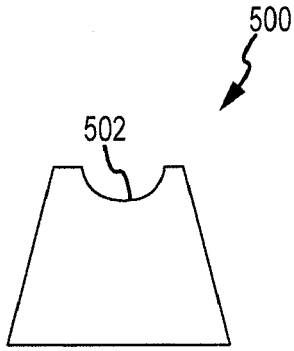
FIGS. 5A, 5B, and 5C show a front, right, and isometric view of a dobie that is a frustum of a pyramid.
Figure 5B:
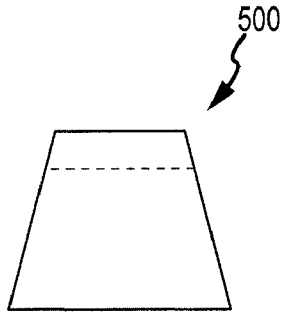
Figure 5C:
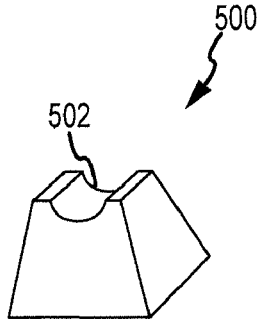

FIGS. 5A, 5B, and 5C show a front, right, and isometric view of a dobie that is a frustum of a pyramid. Referring now to FIGS. 5A, 5B, and 5C, Pyramid Dobie 500 optimizes the use of material by eliminating unnecessary material and is therefore lighter in weight. Pyramid Dobie 500 can be made with or without Slot 502 in the top, which positions and supports the reinforcement, such as rebar. Pyramid Dobie 500 may also have a central tapered hole for tie wire insertion. (See FIGS. 3A, 3B, 4A, 4B, and 4C).

Figure 6A:
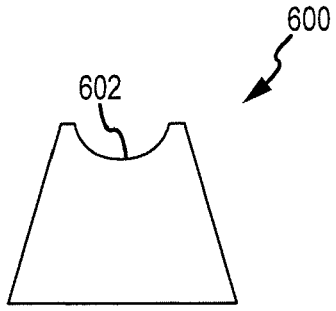
FIGS. 6A, 6B, and 6C show a front, top, and isometric view of a dobie that is a frustum of a right circular cone.
Figure 6B:
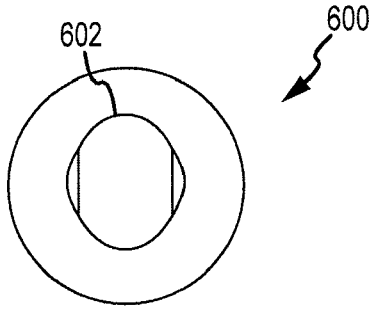
Figure 6C:
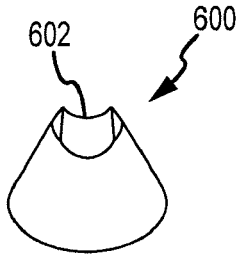

FIGS. 6A, 6B, and 6C show a front, top, and isometric view of a dobie that is a frustum of a right circular cone. Referring now to FIGS. 6A, 6B, and 6C, Cone Dobie 600, like Pyramid Dobie 500 (See FIGS. 5A, 5B, and 5C) also optimizes the use of material by eliminating unnecessary material and therefore is lighter in weight. Cone Dobie 600 may also be made with or without Slot 602 in the top to position and support the reinforcement. Cone Dobie 600 may also have a central tapered hole for tie wire insertion. (See FIGS. 3A, 3B, 4A, 4B, and 4C).

Figure 7A:
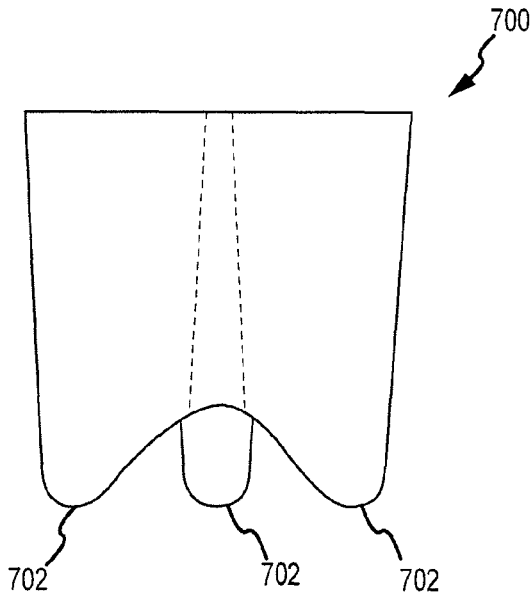
FIGS. 7A and 7B show a front and top view of a tri-legged dobie.
Figure 7B:
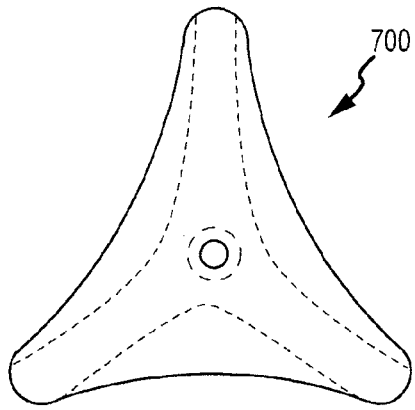

FIGS. 7A and 7B show a front and top view of a tri-legged dobie. Referring now to FIGS. 7A and 7B, Tri-Legged Dobie 700 has three Legs 702 and is similar to Legged Pool/Euro Dobie 400. (See FIGS. 4A, 4B, and 4C). The tri-legged shape optimizes the use of material. It also reduces the area under Tri-Legged Dobie 700 that the poured concrete has to fill to conceal Tri-Legged Dobie 700 on an exposed to view surface. The tri-legged shape also allows Tri-Legged Dobie 700 to be stable on an irregular or uneven surface commonly encountered in the manufacture of architectural concrete products.

Figure 8A:
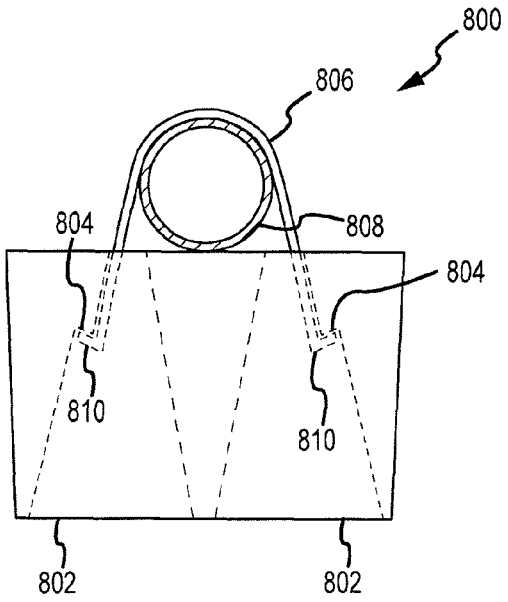
FIGS. 8A and 8B show a front and top view of a cube dobie having a reinforcement securing clip.
Figure 8B:
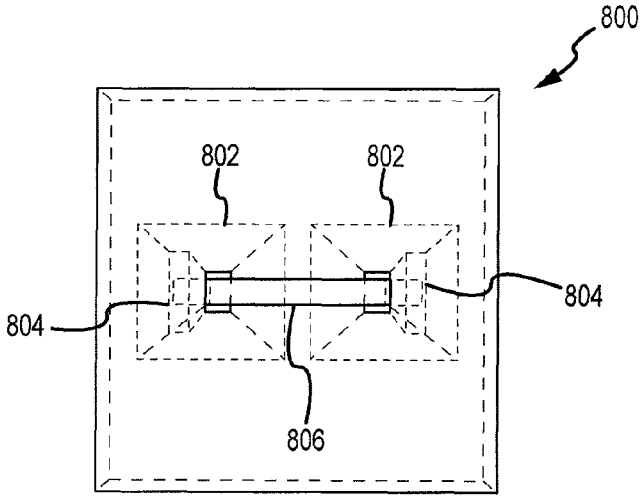

FIGS. 8A and 8B show a front and top view of a cube dobie having a reinforcement securing clip. Referring now to FIGS. 8A and 8B, Cube Dobie 800 has a pair of Voids 802 that are shaped in a frustum of a pyramid. Within Voids 802 are Interior Offsets 804 in the outboard interior walls. Interior Offsets 804 provide anchorage for a steel, plastic or wire Spring-Clip 806 that is placed over the top of the Reinforcement 808 (not shown in FIG. 8B), inserted into the top of Voids 802 and allowed to spring outward against Interior Offsets 804 in the outboard walls of Voids 802. Interior Offsets 804 retain the Bent Ends 810 of Spring-Clip 806, thus preventing it from coming out of Voids 802 of Cube Dobie 800. Spring-Clip 806 may be used with any of the dobie types described herein that are featured with voids and interior offsets similar to Voids 802 and Interior Offsets 804.

Figure 9:
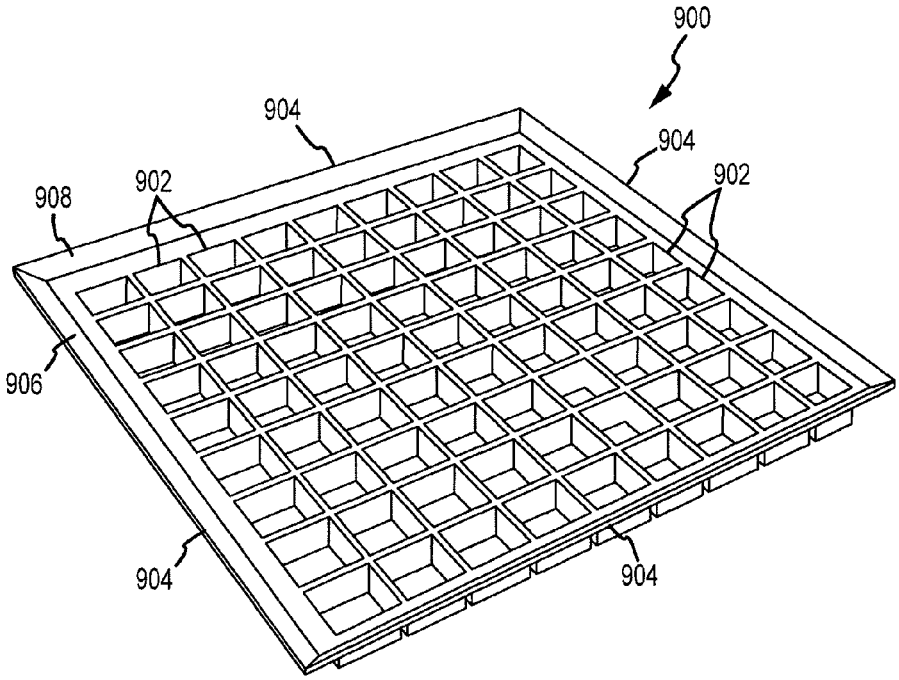
FIG. 9 shows an isometric view of a dobie tray according to one embodiment of the present invention.

FIG. 9 shows an isometric view of a typical dobie tray. Referring now to FIG. 9, Dobie Tray 900 has a plurality of Cavities 902 formed into the tray that can be quickly and efficiently filled with grout to form a plurality of dobies. Edges 904 of the tray have a vertical rise, and then slope down to a top surface of Dobie Tray 900 at an angle, typically 45°, but the angle could be more or less than 45°. When Dobie Tray 900 is placed into a box (See FIG. 11) for filling Cavities 902 with grout, the Edges 904 of Dobie Tray 900 form a seal against the sides of the box and substantially prevent the fluidic grout from running into the bottom of the box or into a lower tray already placed and filled in the box. Dobie Tray 900 has a First Lip 906 adjacent to a Second Lip 908, the function of which is explained in reference to FIGS. 10A, 10B, and 10C.

Figure 10A:
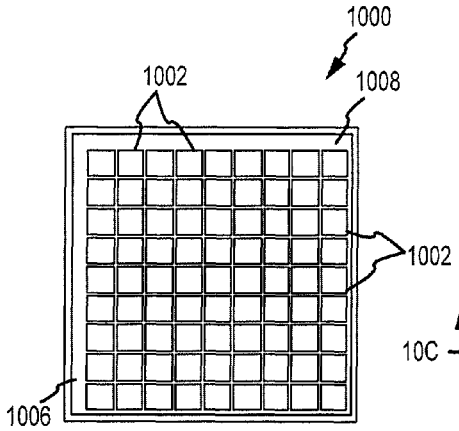
FIGS. 10A, 10B, and 10C show a top view of a first dobie tray oriented in a first position, a top view of a second dobie tray oriented in a second position for stacking purposes, and a cross section view of several dobie trays stacked on top of each other in the alternating first and second positions.
Figure 10B:
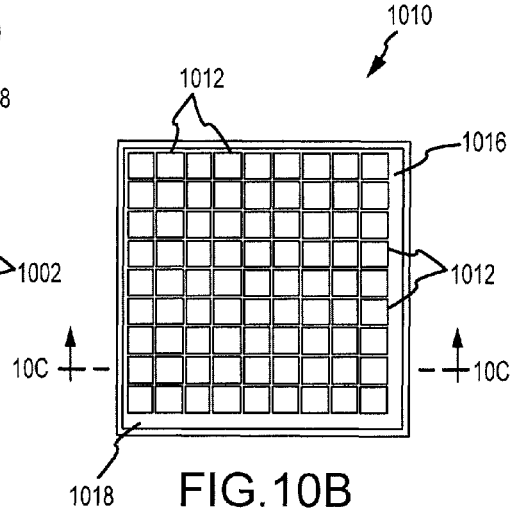
Figure 10C:
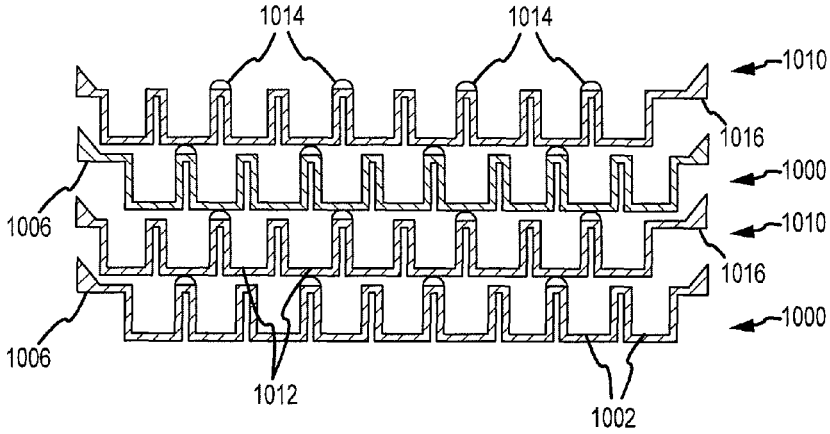

FIGS. 10A, 10B, and 10C show a top view of a first dobie tray oriented in a first position, a top view of a second dobie tray oriented in a second position for stacking purposes, and a cross section view of several dobie trays stacked on top of each other in the alternating first and second positions. Referring now to FIG. 10A, a First Dobie Tray 1000 has a plurality of Cavities 1002 and a First Lip 1006 adjacent to a Second Lip 1008. First Dobie Tray 1000 is placed in the bottom of a box (See FIG. 11) and its Cavities 1002 are filled with grout. Referring now to FIG. 10B, a Second Dobie Tray 1010 having a plurality of Cavities 1012 and a First Lip 1016 adjacent to a Second Lip 1018 is placed on top of First Dobie Tray 1000 in the box oriented in the position shown, which is rotated 180° in relation to that of First Dobie Tray 1000. First Dobie Tray 1000 and Second Dobie Tray 1010 are identical to each other, being made from the same form or mold in the manufacturing process.

FIG. 10C shows a cross section view of several dobie trays stacked on top of each other when viewed along Line 10C in FIG. 10B. Due to the first and second lips of each dobie tray, when the dobie trays are stacked in the 180° rotated position relative to each other, the cavities in each dobie tray are offset by a distance equal to one-half of the width and length of the cavities as shown in FIG. 10C. As successive dobie trays are put into the box for filling, they are rotated 180° so that the intersecting walls of a lower tray support the centers of the cavities of the dobie tray immediately above it. This helps to prevent marring or damage to the dobies in a lower tray during the filling of an upper tray. FIG. 10C shows another First Dobie Tray 1000 and another Second Dobie Tray 1010 stacked on top of the first two Dobie Trays 1000 and 1010. The stacking (with alternating rotated positions) and filling process is repeated until the box is filled with dobie trays. Boxes may be designed to hold differing numbers of dobie trays based upon practical considerations, such as weight, size, and ease of handling. Once the box is filled, the box is closed up and sealed, and the grout is allowed to cure for an appropriate period of time.

Though First Dobie Tray 1000 and Second Dobie Tray 1010 are shown as being square, one skilled in the art will recognize that a rectangular shape, with two adjacent lips, would also accomplish the same functionality as the square shape when a first rectangular dobie tray is overlaid with a second rectangular dobie tray rotated 180° in respect to the first rectangular dobie tray. The cavities in each rectangular dobie tray are offset by a distance equal to one-half of the width and length of the cavities. The boxes for the rectangular dobie trays would therefore have to be rectangular as well and sized to fit the rectangular dobie trays snugly on all four sides. One skilled in the art will also recognize that a rectangular dobie tray with only one lip, and over laid with an identical rectangular dobie tray with one lip rotated 180° in respect to the lower tray, would result in an offset of the cavities only in one direction (length only or width only depending upon what side the lip is located), and not two, which is not as optimal as having two lips on the dobie trays.

Dobie Trays 1000/1010 may also have a plurality of Spacing Pins 1014 located at the intersection of the walls of the plurality of Cavities 1002/1012 of Dobie Trays 1000/1010 to support the plurality of cavities of an upper tray. Spacing Pins 1014 are formed into the trays. Trays may or may not have Spacing Pins 1014, and Spacing Pins 1014 may not be located on every intersection of the walls of the cavities, but separated from each other on every-other wall intersection, as shown in FIG. 10C, or a greater spacing as desired. Spacing Pins 1014 not only support an upper tray but may also help to insure that a set of dobie trays within a box (see FIG. 11) completely fill the inside height of the box. This allows for a given box depth to be utilized with a variety of dobie types. It is desirable for the dobie trays to fill the boxes to the top so that when boxes are stacked one atop the other, the lower boxes are not crushed or buckled by the weight of the upper boxes and made to look unsightly. If boxes do collapse or crush slightly, when stacked, it typically does not affect or damage the dobies within the boxes due to the structural support supplied by each individual dobie tray.

Figure 11:
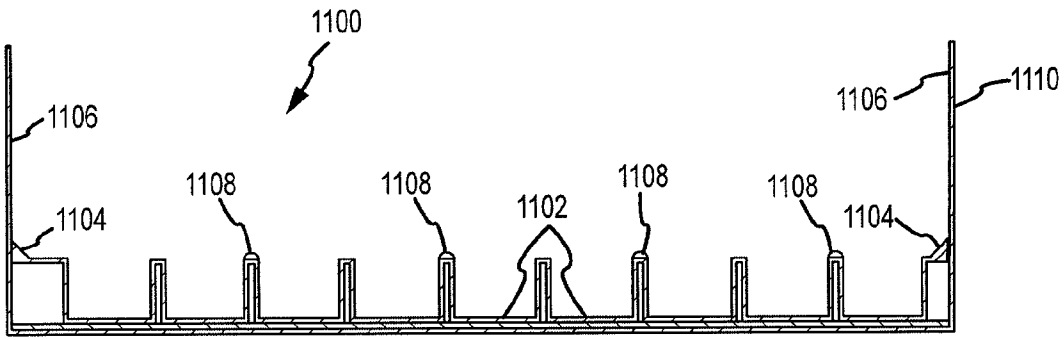
FIG. 11 shows a section view through a box with one dobie tray inserted inside.

FIG. 11 shows a section view through a box with one dobie tray inserted inside. Referring now to FIG. 11, Dobie Tray 1100 is placed in the bottom of Box 1110. Edges 1104, typically having a slope of 45°, fit snugly against the Interior Walls 1106 of Box 1110 forming a seal such that any grout that is sprayed on the Interior Walls 1106 will run down and be deflected by the 45° slope into one or more of the plurality of Cavities 1102 that are located along the perimeter of Dobie Tray 1100.

As described above, Dobie Tray 1100 may also have a plurality of Spacing Pins 1108 located at the intersection of the walls of the plurality of Cavities 1102 of Dobie Tray 1100 to support the plurality of cavities of an upper tray.

Figure 12:
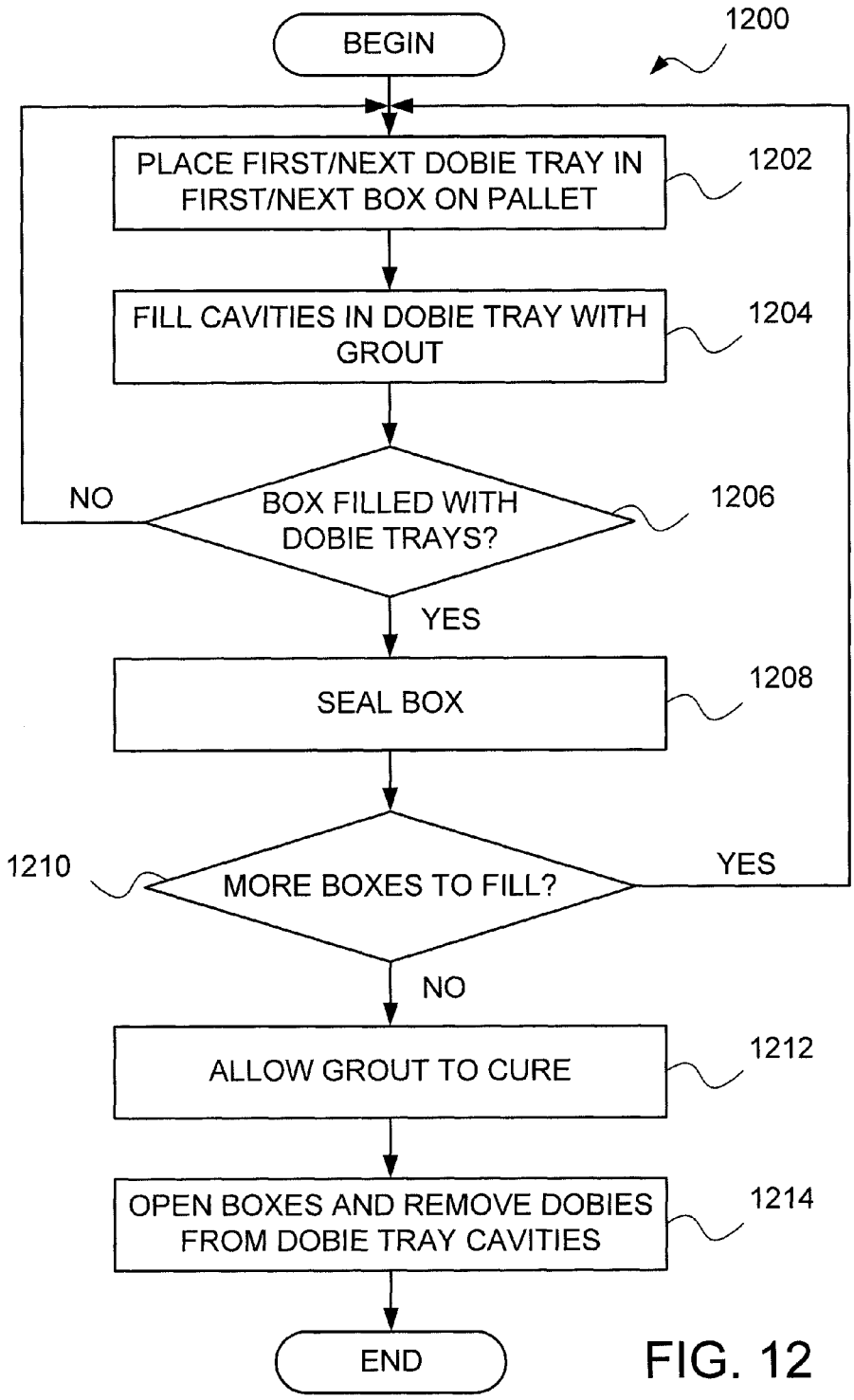
FIG. 12 shows a flow chart of a general method for producing dobies according to one embodiment.

FIG. 12 shows a flow chart of a general method for manufacturing dobies according to the present invention. Referring now to FIG. 12, the manufacturing process 1200 begins with step 1202 where a first empty dobie tray is placed in the bottom of a first box sized so that the angled edges of the dobie tray contact the interior walls of the box. The box is typically placed on a pallet at or near the work site or the point of sale so that after curing, the pallet with multiple boxes is where the dobies will be used, or can be conveniently moved closer to where the dobies will actually be used.

In step 1204 the cavities in the first empty dobie tray are filled with grout utilizing a grout mixing and pumping machine. One example of a grout mixing and pumping machine is the Utiform Quattro Continuous Mixing Grouting System available from ChemGrout, Inc., 805 E. 31$^{st}$ Street, LaGrange Park, Ill. 60526. Other grout mixing and pumping machines are available from other suppliers and may be suitably used for the method described herein.

In step 1206 it is determined if the box has been filled to the top with dobie trays. If not, then the method returns to step 1202 where a next empty dobie tray is positioned on top of the already placed and filled dobie tray. As described above in relation to FIGS. 10A, 10B, and 10C, the dobie tray currently being placed is rotated 180° in relation to the already placed and filled dobie tray so that the intersecting walls of the already placed and filled dobie tray support the centers of the cavities of the dobie tray currently being placed. Steps 1202 and 1204 are repeated until the box is full, as determined in step 1206.

Once the box is full of dobie trays that have been filled with grout, in step 1208 the box is closed up and sealed. Step 1210 determines if there are more boxes on the pallet to be filled with dobie trays. If yes, then the method returns to step 1202 where a next empty dobie tray is positioned in the bottom of the next box. Steps 1202 through 1208 are repeated until all the boxes on the pallet have been filled and sealed, as determined in step 1210.

After all the boxes on the pallet have been filled and sealed, the grout is allowed to cure in step 1212. The cure time will vary depending upon the type of grout. A cure time of about seven days is required before the dobies can be shipped. Approximately 28 days is required for full curing. After curing, in step 1214 the boxes are opened and the dobie trays are removed. The individual dobies are then removed from the cavities and are ready to be used.

One skilled in the art will recognize that many modifications to the above described method may be employed. For example, all the boxes that will fit on the pallet in a first layer may be placed on the pallet, and then, an empty dobie tray may be placed in each empty box. The dobie trays are filled with grout, and then a next dobie tray is placed in each of the boxes on top of the filled dobie trays. These new empty dobie trays are filled, and next dobie trays are added. This process is repeated until the boxes are full. The boxes are then sealed, and a next layer of boxes, if desired, can be placed on top of the first layer of boxes. The entire process above is then repeated until this new layer of boxes are filled with grout-filled dobie trays and the boxes are sealed. The entire process repeats again if another layer of boxes is desired.

There are many other possible dobie types, configurations, and appliances that may be developed in conjunction with the above described manufacturing method. The dobie types, dimensions, and methods described above are in no way intended to describe the full scope of the capabilities of the method nor limit this disclosure to the specific contents and embodiments shown.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It will be understood by those skilled in the art that many changes in construction and widely differing embodiments and applications will suggest themselves without departing from the scope of the disclosed subject matter.

What is claimed is:

1. A method for manufacturing dobies, the method comprising the steps of:

(a) placing a first dobie tray in a first box;

(b) filling a plurality of cavities in the first dobie tray with a cementitious material;

(c) placing a second dobie tray identical to the first dobie tray in the first box on top of the first dobie tray, wherein the second dobie tray is oriented in a position that is rotated in respect to the first dobie tray so that the first dobie tray provides support to the second dobie tray;

(d) filling a plurality of cavities of the second dobie tray with cementitious material;

(e) sealing the first box; and (f) allowing the cementitious material in the plurality of cavities in the first dobie tray and in the plurality of cavities in the second dobie tray within the first box to cure;

wherein said placing further comprises:

forming a seal between each edge of the first dobie tray with a corresponding side of the first box; and forming a seal between each edge of the second dobie tray with a corresponding side of the first box;

wherein the seals substantially prevent the cementitious material from running from the second dobie tray into the first dobie tray, and from running from the first dobie tray into a bottom of the first box;

wherein each edge of the first and second dobie trays has a vertical rise and a sloping portion that slopes downward from the vertical rise towards a top surface of the first and second dobie trays;

wherein any of the cementitious material that is sprayed on an interior walls of the first box will run down and be deflected by the sloping portion of the each edge into the plurality of cavities of the first and second dobie trays.

2. The method according to claim 1 further comprising the step of:

placing the first box on a pallet that is located near one of a work site where the dobies are needed or a point of sale of the dobies prior to placing the first dobie tray in the first box.

3. The method according to claim 2 further comprising the steps of:

placing a one or more additional boxes on the pallet to form a first layer of boxes; and repeating said steps (a) through (f) for each of the one or more additional boxes in the first layer of boxes.

4. The method according to claim 3 further comprising the steps of:

placing a second layer of boxes on top of the first layer of boxes after the first layer of boxes are filled and sealed, and repeating said steps (a) through (f) for each box in the second layer of boxes.

5. The method according to claim 3 further wherein said placing steps further comprise the steps of:

placing the first dobie tray in a first position in the box, wherein the first dobie tray has a first lip adjacent to a second lip, and placing the second dobie tray on top of the first dobie tray in a second position, wherein the second position rotates the second dobie tray 180° in respect to the first dobie tray, wherein a first lip adjacent to a second lip of the second dobie tray are not directly over the first lip and the second lip of the first dobie tray.

6. The method according to claim 1 further comprising the steps of:

placing a next dobie tray identical to the first and second dobie trays in the first box on top of the second dobie tray, wherein the next dobie tray is oriented in a position that is rotated 180° in respect to the second dobie tray, wherein a first lip adjacent to a second lip of the next dobie tray are not directly over the first lip and the second lip of the second dobie tray;

filling a plurality of cavities of the next dobie tray with the cementitious material; and repeating said placing and filling steps immediately above until a last dobie tray fills the first box to a top of the first box.

7. The method according to claim 1 further comprising the step of:

removing the dobies from the first and second dobie trays after the dobies have cured.

8. The method according to claim 1 wherein said placing step (c) further comprises the step of:

separating the first dobie tray from the second dobie tray with a plurality of spacer pins located on the first dobie tray at a plurality of intersections of a plurality of walls of the plurality of cavities;

wherein the plurality of spacer pins support the plurality of cavities of the second dobie tray.

9. The method according to claim 1 further comprising the step of:

inserting a securing appliance in each of the plurality of cavities in the first and second dobie trays prior to said placing steps (a) and (c).

* * * * *